US005957421A

United States Patent [19]

Barbour

[11] Patent Number: 5,957,421

[45] Date of Patent: Sep. 28, 1999

[54] RETAINER DEVICE

[76] Inventor: Lee Barbour, 2000 Florence Ave., Chester, Va. 23836

[21] Appl. No.: 09/007,294

[22] Filed: Jan. 14, 1998

[51] Int. Cl.[6] ..... A47B 96/06

[52] U.S. Cl. ..... 248/220.21; 248/225.11; 248/314; 224/904; 224/584; 224/197; 224/271; 24/597

[58] Field of Search ..... 224/904, 584, 224/197, 199, 271, 272; 248/220.21, 225.11, 224.31, 314; 24/597, 665, 590

[56] References Cited

U.S. PATENT DOCUMENTS

| | | | |
|---|---|---|---|
| 4,088,848 | 5/1978 | Weed | 179/146 R |
| 4,419,794 | 12/1983 | Horton, Jr. et al. | 24/667 |
| 5,026,016 | 6/1991 | Lisowski | 248/314 |
| 5,035,389 | 7/1991 | Wang | 248/224 |
| 5,054,170 | 10/1991 | Otrusina | 24/597 |
| 5,375,749 | 12/1994 | Oliva | 224/271 |
| 5,428,866 | 7/1995 | Aschow | 16/30 |
| 5,567,038 | 10/1996 | Lary | 362/106 |
| 5,593,121 | 1/1997 | Tackett | 248/218.4 |
| 5,604,958 | 2/1997 | Anscher | 24/3.1 |
| 5,622,296 | 4/1997 | Pirhonen et al. | 224/197 |
| 5,729,869 | 3/1998 | Anscher | 24/3.1 |

*Primary Examiner*—Ramon O. Ramirez
*Assistant Examiner*—Kimberly Wood
*Attorney, Agent, or Firm*—Michael I. Kroll

[57] ABSTRACT

A retainer device (10) for holding tools (12) in a removable manner to a utility belt (14) and a wall (16) comprising a plurality of clip members (18). A facility (20) is for mounting the clip members (18) to the utility belt (14) and the wall (16). A plurality of stud members (22) are provided. An assemblage (24) is for affixing each of the stud members (22) to a tool (12). In a first instance, each tool (12) with one stud member (22) can quickly engage with and disengage from any one clip member (18) on the utility belt (14) for work purposes. In a second instance, each tool (12) with one stud member (22) can quickly engage with and disengage from any one clip member (18) on the wall (16) for storage purposes.

3 Claims, 6 Drawing Sheets

RETAINER DEVICE

BACKGROUND OF THE INVENTION

1. Field of the Invention

The instant invention relates generally to mounting apparatuses and more specifically it relates to a retainer device. The retainer device consists of a plurality of clip members and stud members. Some of the clip members are mounted to a utility belt, while the stud members are mounted to tools. The tools with the stud members can quickly engage with and disengage from the clip members on the utility belt for work purposes. Some of the clip members are also mounted to a wall. The tools with the stud members can quickly engage with and disengage from the clip members on the wall for storage purposes.

2. Description of the Prior Art

Numerous mounting apparatuses have been provided in prior art. For example, U.S. Pat. No. 5,026,016 to Lisowski; U.S. Pat. No. 5,035,389 to Wang; U.S. Pat. No. 5,428,866 to Aschow and U.S. Pat. No. 5,593,121 to Tackett all are illustrative of such prior art. While these units may be suitable for the particular purpose to which they address, they would not be as suitable for the purposes of the present invention as heretofore described.

LISOWSKI, WALTER E.

RETAINER CLIP

U.S. Pat. No. 5,026,016

A one-piece molded retainer clip is mountable onto any desired surface. The retainer clip includes a back wall for mounting to the surface and a raised front wall having a mounting button access slot formed therein. A clip finger having a resilient end portion extends from the back wall into the access slot to bear against the mounting button when inserted therein. The access slot has a pair of guide walls and overlying wall portions to engage and retain a flange of the mounting button. The clip finger preferably is biased against the mounting button and can includes a projection for engagement with the mounting button or an electrical ground or a resilient biasing member.

WANG, SHU-SAN

MOUNTING DEVICE

U.S. Pat. No. 5,035,389

A mounting device includes a trapezoidal plate with a tapered top edge and a bottom edge. A pair of ribs project from the bottom edge. Each of the ribs has a first portion and a second portion, the latter each having an engaging member at its end. The second portions are resilient and separated from the plate. The mounting device also has an attached body attached to a receptacle. The attached body includes a pair of attaching members, each of which has a channel and a guiding path formed in-between the channels. The trapezoidal plate can be inserted into the guiding path of the attached body to engage the same by the engaging members of the ribs.

ASCHOW, JAMES

EXTRUDED MOUNTING PLATE FOR DETACHABLE HEAVY DUTY CASTER

U.S. Pat. No. 5,428,866

A mounting plate for detachably fixing a heavy duty, normally permanently attached, swiveling base plate caster roller unit to an object to be transported is cut from an extrusion shaped to form a flat bottom plate with raised parallel sides each including an overhanging flange such that parallel grooves are provided into which the caster's swiveling base plate can slide. Attachment of the mounting plate to the transportable object utilizes at least two mounting pins (screws, bolts or rivets), at least one of which protrudes from the mounting plate inside surface to form a stop to prevent the swivel plate from sliding all the way through. A spring loaded button, which becomes flush with the mounting plate when depressed, allows the caster swivel plate to enter the cavity provided by the parallel extruded grooves and the protruding mounting stop. When released, the spring loaded button protrudes from the mounting plate surface such that the cavity is now closed on all four sides and the caster's swivel plate is securely attached. Chamfered edges on the side walls and flanges allow the mounting plate to act as a glide when the caster is removed therefrom.

TACKETT, ROY E.

DETACHABLE TREE MOUNT FOR ARROW QUIVERS

U.S. Pat. No. 5,593,121

An apparatus for supporting an arrow quiver on or about a tree trunk or branch or a post. The apparatus comprising a mounting block through which a strap may be inserted. The strap having fasteners such as a pair of D-rings, which allow for attaching the apparatus to a tree trunk or branch. With the apparatus thus attached to the tree, an arrow quiver designed for mounting to a bow, may be removed from the bow and mounted unto the apparatus. The mounting block is designed to have mounting openings allowing for easy mounting of most standard arrow quivers while certain arrow quivers may require the addition of an adapter to allow mounting to the apparatus.

SUMMARY OF THE INVENTION

A primary object of the present invention is to provide a retainer device that will overcome the shortcomings of the prior art devices.

Another object is to provide a retainer device that consists of a plurality of clip members and stud members, in which some of the clip members are mounted to a utility belt, while the stud members are mounted to tools, so that the tools with the stud members can be quickly engaged with and disengaged from the clip members on the utility belt for work purposes.

An additional object is to provide a retainer device, in which some of the clip members are also mounted to a wall, so that the tools with the stud members can quickly engage with and disengage from the clip members on the wall for storage purposes.

A further object is to provide a retainer device that is simple and easy to use.

A still further object is to provide a retainer device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
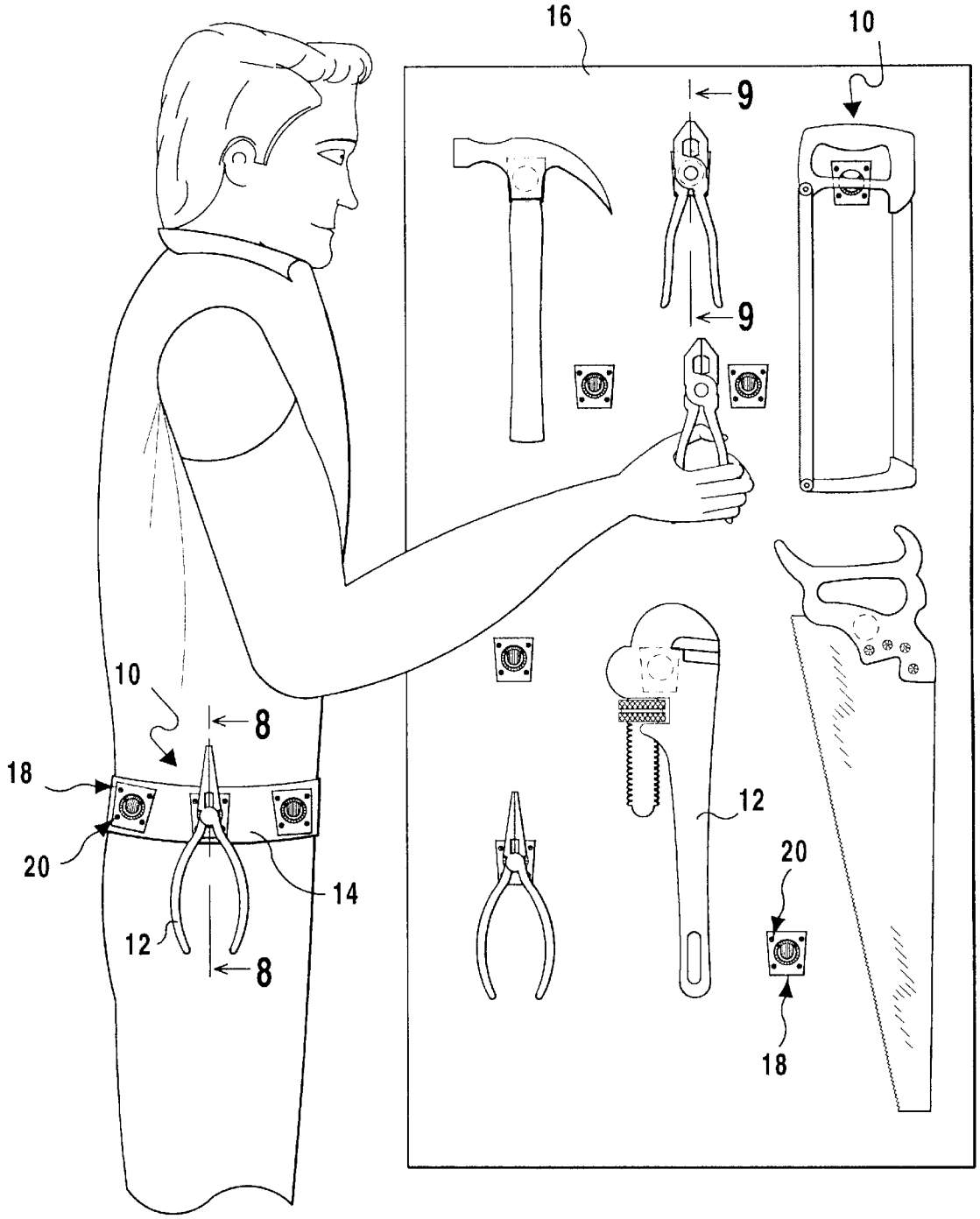
FIG. 1 is an elevational view showing the present invention in use.
Figure 2:
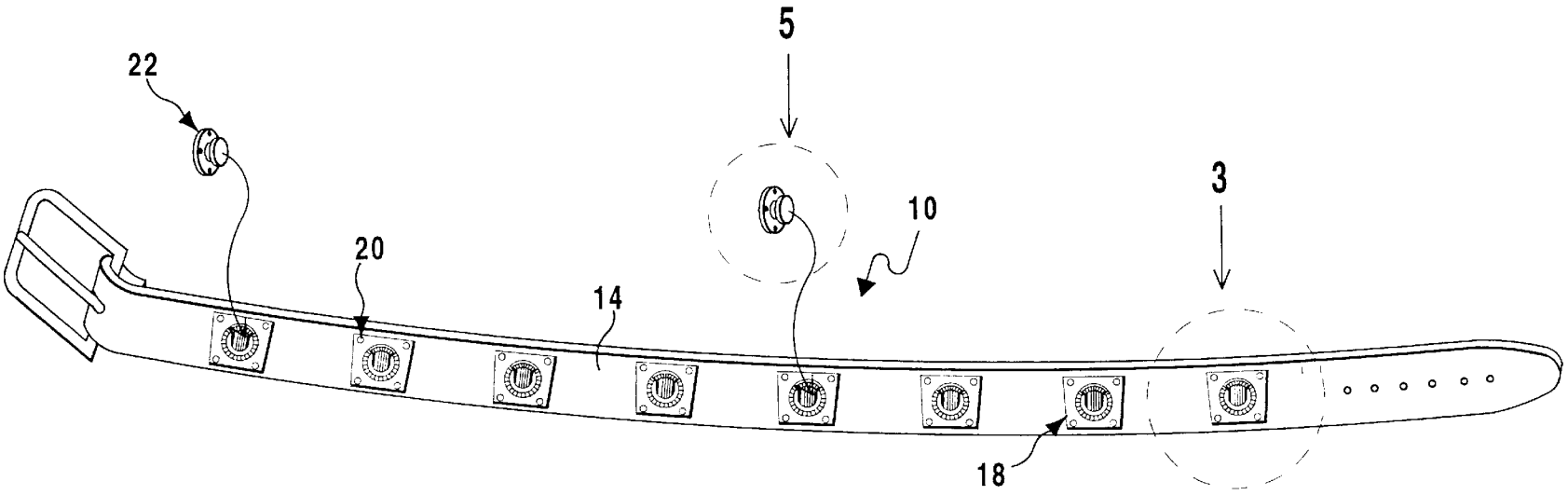
FIG. 2 is a perspective view of the utility belt in FIG. 1.
Figure 3:
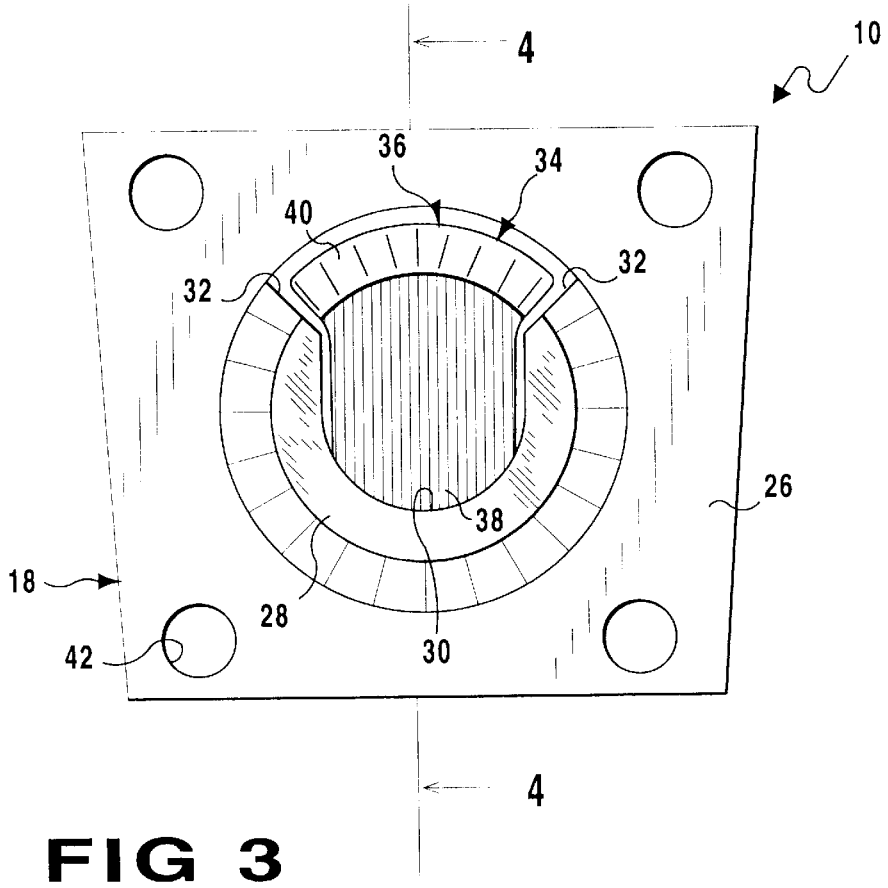
FIG. 3 is an enlarged front view of one clip member as indicated by arrow 3 in FIG. 2.
Figure 4:
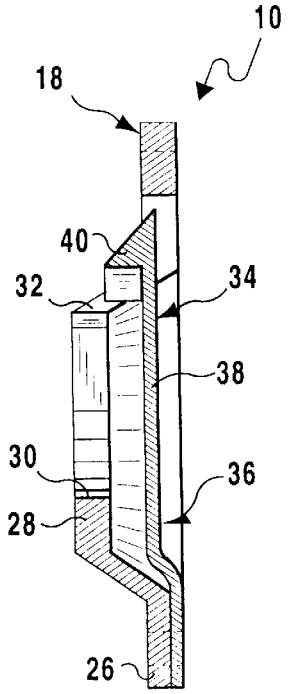
FIG. 4 is a cross sectional view taken along line 4—4 in FIG. 3.

Turning now descriptively to the drawings, in which similar reference characters denote similar elements throughout the several views, FIGS. 1 through 9 illustrate the present invention being a retainer device 10. With regard to the reference numerals used, the following numbering is used throughout the various drawing figures.

| | |
|---|---|
| 10 | retainer device |
| 12 | tool |
| 14 | utility belt |
| 16 | wall |
| 18 | clip member of 10 |
| 20 | mounting facility of 10 |
| 22 | stud member of 10 |
| 24 | affixing assemblage of 10 |
| 26 | plate of 18 |
| 28 | raised portion of 26 |
| 30 | slot in 28 |
| 32 | guide edge of 30 |
| 34 | holding structure of 18 |
| 36 | spring lock for 34 |
| 38 | flexible flat arm of 36 |
| 40 | tapered projection of 36 |
| 42 | hole in 18 |
| 44 | fastener of 20 |
| 46 | flange of 22 |
| 48 | neck of 22 |
| 50 | disc shaped head of 22 |
| 52 | layer of adhesive for 24 |
| 54 | set of mating hook and loop strips of 24 |
| 56 | first layer of adhesive for 24 |
| 58 | second layer of adhesive for 24 |

The retainer device 10 is for holding tools 12 in a removable manner to a utility belt 14 and a wall 16 and comprises a plurality of clip members 18. A facility 20 is for mounting the clip members 18 to the utility belt 14 and the wall 16. A plurality of stud members 22 are provided. An assemblage 24 is for affixing each of the stud members 22 to a tool 12. In a first instance, each tool 12 with one stud member 22 can quickly engage with and disengage from any one clip member 18 on the utility belt 14 for work purposes. In a second instance, each tool 12 with one stud member 22 can quickly engage with and disengage from any one clip member 18 on the wall 16 for storage purposes.

Each clip member 18 is a plate 26 having a raised portion 28 with an access slot 30. The access slot 30 is in a generally Y-shaped configuration having two upper guide edges 32, to help direct one stud member 22 into the access slot 30.

Each clip member 18 further includes a structure 34 for holding one stud member 22 within the access slot 30 in the raised portion 28 of the plate 26, to prevent the stud member 22 from accidentally dislodging therefrom when the clip member 18 is turned upside down. The holding structure 34 is a spring lock 36.

The spring lock 36 includes a flexible flat arm 38 attached at a lower end to a bottom rear surface of the plate 26 and extends upwardly behind the access slot 30. A tapered projection 40 is on an upper end of the flexible flat arm 38. The tapered projection 40 will normally protrude over the access slot 30, to allow one stud member 22 to slide into the access slot 30 and be held therein, until the tapered projection 40 is manually depressed rearwardly on the flexible flat arm 38, to allow the stud member 22 to slide out of the access slot 30.

The mounting facility 20 consists of each clip member 18 having a plurality of holes 42 therethrough. A plurality of fasteners 44 are provided, which pass through the holes 42 to retain each clip member 18 to the utility belt 14 and the wall 16.

Figure 5:
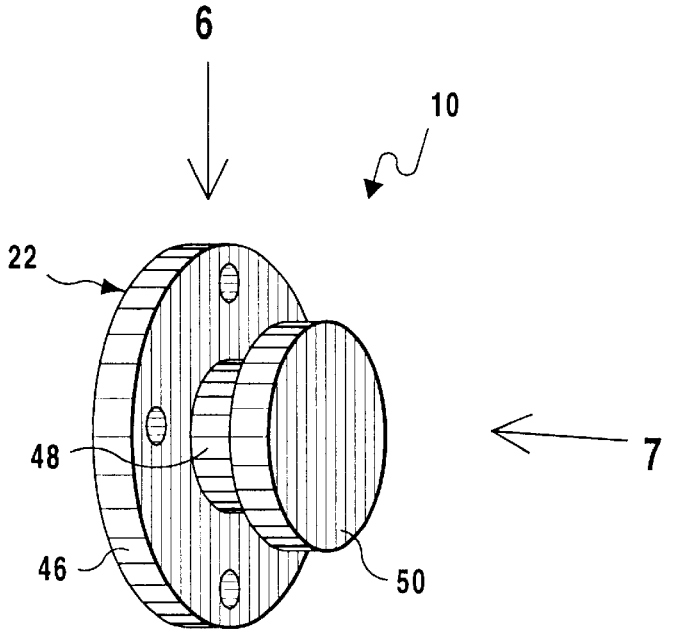
FIG. 5 is an enlarged perspective view of one stud member as indicated by arrow 5 in FIG. 2.
Figure 6:
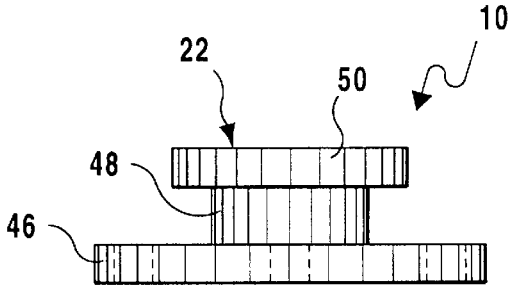
FIG. 6 is a side view taken in the direction of arrow 6 in FIG. 5.
Figure 7:
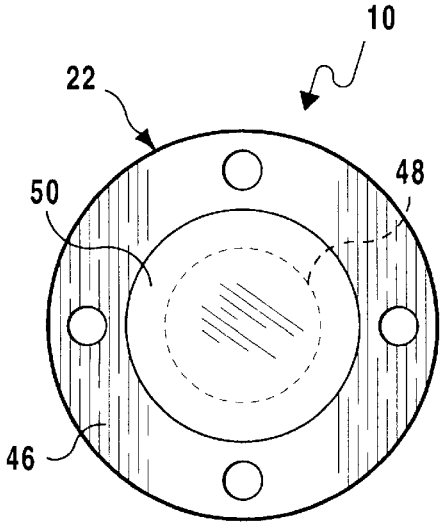
FIG. 7 is a front view taken in the direction of arrow 7 in FIG. 5.

Each stud member 22, as best seen in FIGS. 5, 6 and 7, includes a flange 46. A neck 48 is integral with and extends from the flange 46. A disc shaped head 50 is integral with the neck 48 opposite from the flange 46.

Figure 8:
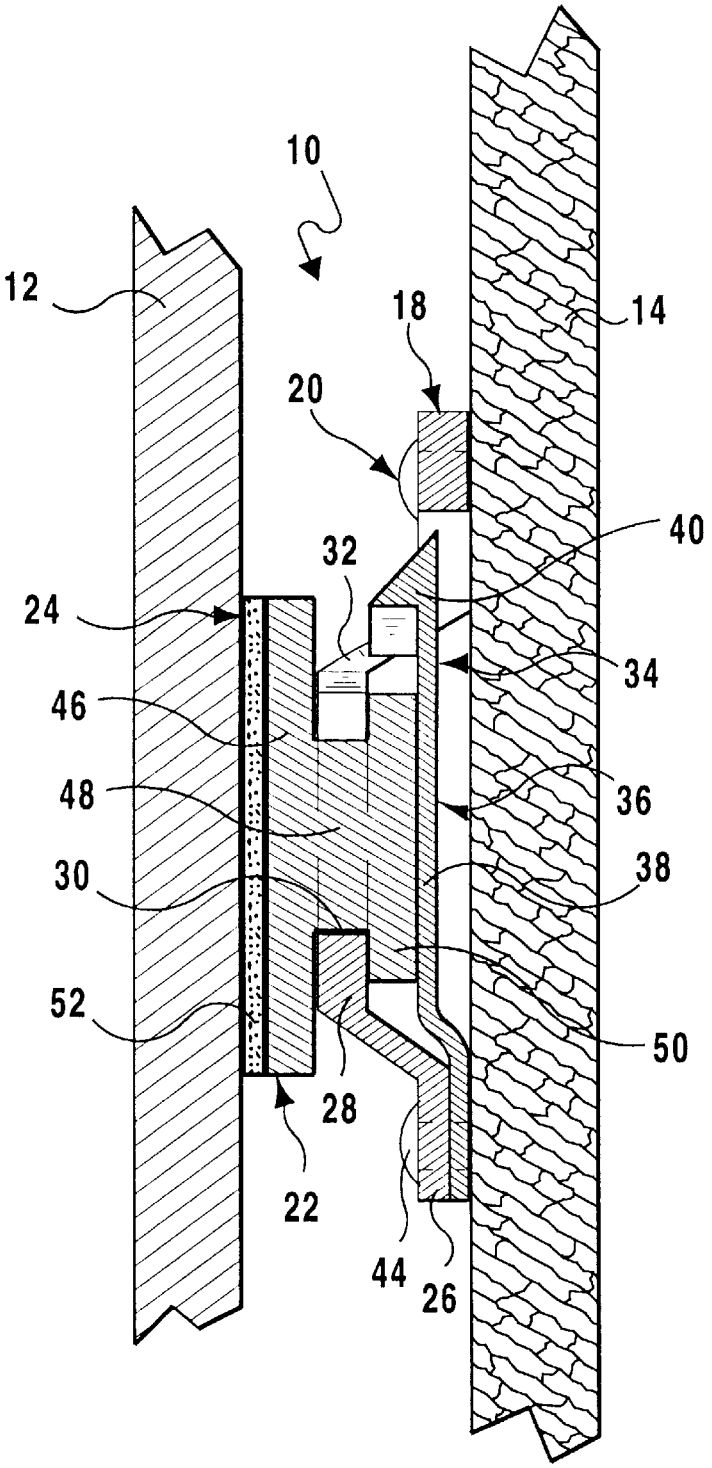
FIG. 8 is an enlarged cross sectional view taken along line 8—8 in FIG. 1.
Figure 9:
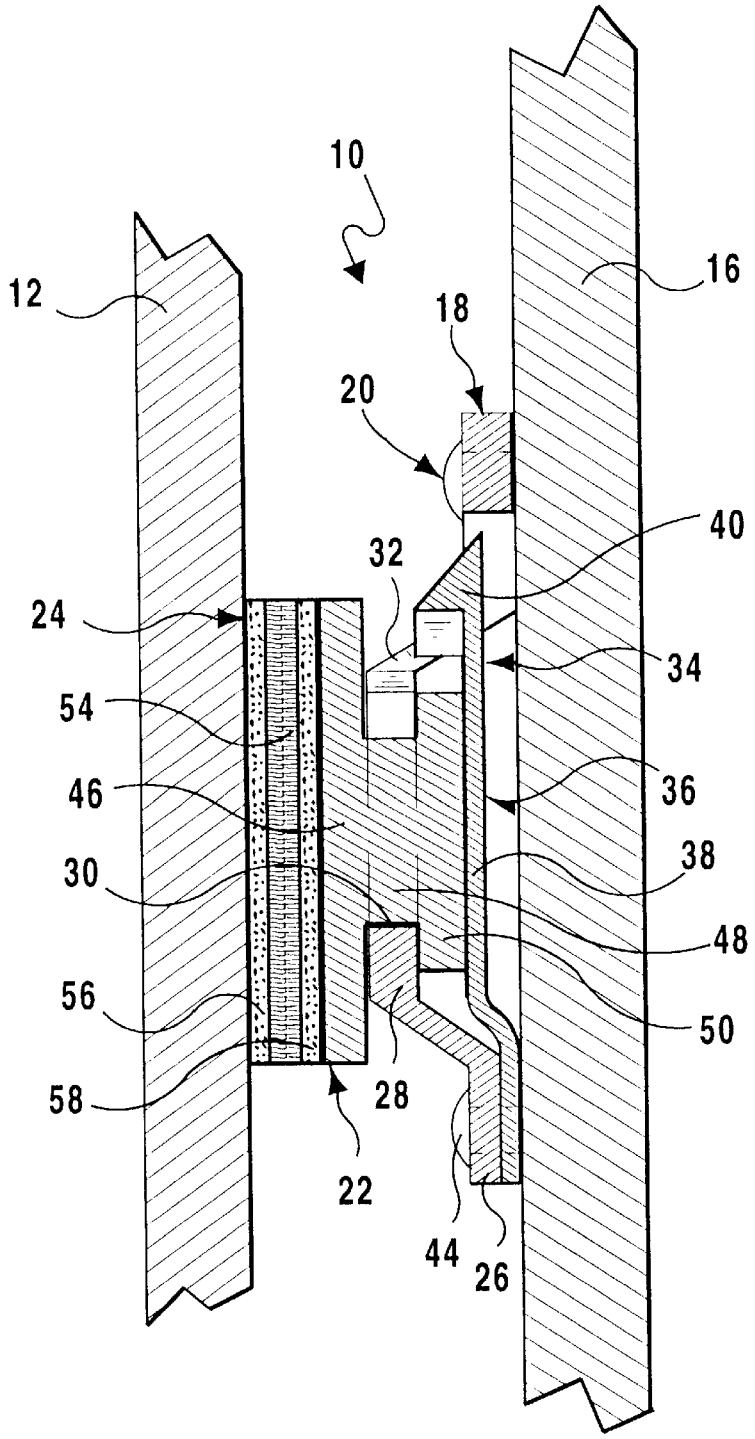
FIG. 9 is an enlarged cross sectional view taken along line 9—9 in FIG. 1.

Each affixing assemblage 24, as shown in FIG. 8, is a layer of adhesive 52 applied between one tool 12 and the flange 46 of one stud member 22. Each affixing assemblage 24, as shown in FIG. 9, contains a set of mating hook and loop strips 54. A first layer of adhesive 56 is applied between one tool 12 and a first side of the set of mating hook and loop strips 54. A second layer of adhesive 58 is applied between the flange 46 of one stud member 22 and a second side of the set of mating hook and loop strips 54.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A retainer device in combination with a utility belt, a tool and a wall for holding tools in a removable manner to the utility belt and the wall comprising:

a) a plurality of identical clip members;

b) means for mounting some of said clip members on the utility belt worn by a user and some of said clip members on the wall;

c) a plurality of stud members for removable engagement to said clip members;

d) means for affixing each of said stud members to the tool, so that in a first instance each tool with one said stud member can quickly engage with and disengage from any one said clip member on the utility belt for work purposes, while in a second instance each tool with one said stud member can quickly engage with and disengage from any one said clip member on the wall for storage purposes;

e) each said stud member including a flange, a neck integral with and extending from said flange, and a disc shaped head integral with said neck opposite from said flange;

f) each said clip member being a plate with a raised portion with an access slot for receiving the disc shaped head of said stud member, said access slot having a spring lock to block in a positive manner the separation of said stud member from said clip member, said spring lock comprising a flexible flat arm attached at a lower end to a bottom rear surface of said plate and extending upwardly behind said access slot, and a tapered projection on an upper end of said flexible flat arm, said projection normally protruding over said access slot to allow said stud member to slide into said access slot and be directly blocked from removal from said slot by said projection, requiring said tapered projection to be manually depressed rearwardly on said flexible flat arm to allow said stud member to slide out of said access slot; and g) said affixing means comprising pairs of mating hook and loop strips, one hook or loop strip attached by adhesive to one tool, and the mating hook or loop strip attached by adhesive to said flange on one said stud member, so that said tool and stud member together can be mounted on said belt or wall and be readily transferable between said wall and belt.

2. A retainer device as recited in claim 1, wherein said access slot is in a generally Y-shaped configuration having two upper guide edges to help direct one said stud member into said access slot.

3. A retainer device as recited in claim 1, wherein said mounting means includes:

a) each said clip member having a plurality of holes therethrough; and b) a plurality of fasteners which pass through said holes to retain each said clip member to the utility belt and the wall.

* * * * *